US011180924B1

(12) United States Patent
Mendiluza

(10) Patent No.: US 11,180,924 B1
(45) Date of Patent: Nov. 23, 2021

(54) WINDOWED TILE LEVELER

(71) Applicant: EVEN TILE USA, LLC, Cape Coral, FL (US)

(72) Inventor: Raunier Mendiluza, Cape Coral, FL (US)

(73) Assignee: Even Tile USA, LLC, Cape Coral, FL (US)

( * ) Notice: Subject to any disclaimer, the term of this patent is extended or adjusted under 35 U.S.C. 154(b) by 0 days.

(21) Appl. No.: 17/073,054

(22) Filed: Oct. 16, 2020

(51) Int. Cl.
*E04F 21/22* (2006.01)

(52) U.S. Cl.
CPC ..... *E04F 21/22* (2013.01)

(58) Field of Classification Search
CPC ..... E04F 21/20; E04F 21/22; E04F 21/1844; E04F 21/0092; E04F 13/0892; E04F 15/02005
See application file for complete search history.

(56) References Cited

U.S. PATENT DOCUMENTS

D492,210 S * 6/2004 Shilo ..... D10/64
7,536,802 B1 5/2009 Tavy et al.
7,992,354 B2 8/2011 Doda, Jr.
8,205,348 B2 * 6/2012 Baros ..... E04F 21/0092 33/526
8,720,143 B2 * 5/2014 Noutsis ..... E04F 21/0092 52/389
9,121,187 B1 * 9/2015 Bunch ..... E04F 21/18
9,347,228 B1 * 5/2016 Bunch ..... E04F 21/18
D758,218 S * 6/2016 Bunch ..... D10/64
D758,899 S * 6/2016 Bunch ..... D10/64
D857,482 S * 8/2019 Li ..... D8/354
D889,939 S * 7/2020 Bordin ..... D8/354
2004/0060184 A1 * 4/2004 Shilo ..... E04F 21/0092 33/526
2004/0250435 A1 * 12/2004 Fiore ..... E04F 21/0092 33/527
2019/0338536 A1 * 11/2019 Bordin ..... E04F 15/02022

* cited by examiner

*Primary Examiner* — Babajide A Demuren
(74) *Attorney, Agent, or Firm* — Kunzler Bean & Adamson; Scott D. Thorpe

(57) ABSTRACT

For leveling tile, a tile leveler includes a base, three full joint spacers, and a partial joint spacer. The base includes a base window that is free of obstruction in first axis. The three full joint spacers extend from the base in a proximal direction relative to the first axis and extend from the base in a distal direction relative to the first axis. The partial joint spacer extends from the base in the proximal direction along the first axis and does not extend from the base in the distal direction along the first axis.

6 Claims, 5 Drawing Sheets

WINDOWED TILE LEVELER

FIELD

The subject matter disclosed herein relates to a tile leveler and more particularly relates to a windowed tile leveler.

BACKGROUND

Description of the Related Art

Viewing a tile intersection is useful when leveling tile.

BRIEF SUMMARY

A tile leveler for leveling tile is disclosed. The tile leveler includes a base, three full joint spacers, and a partial joint spacer. The base includes a base window that is free of obstruction in first axis. The three full joint spacers extend from the base in a proximal direction relative to the first axis and extend from the base in a distal direction relative to the first axis. The partial joint spacer extends from the base in the proximal direction along the first axis and does not extend from the base in the distal direction along the first axis.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The term "and/or" indicates embodiments of one or more of the listed elements, with "A and/or B" indicating embodiments of element A alone, element B alone, or elements A and B taken together.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The description of elements in each figure may refer to elements of proceeding figures. Like numbers refer to like elements in all figures, including alternate embodiments of like elements.

Figure 1:
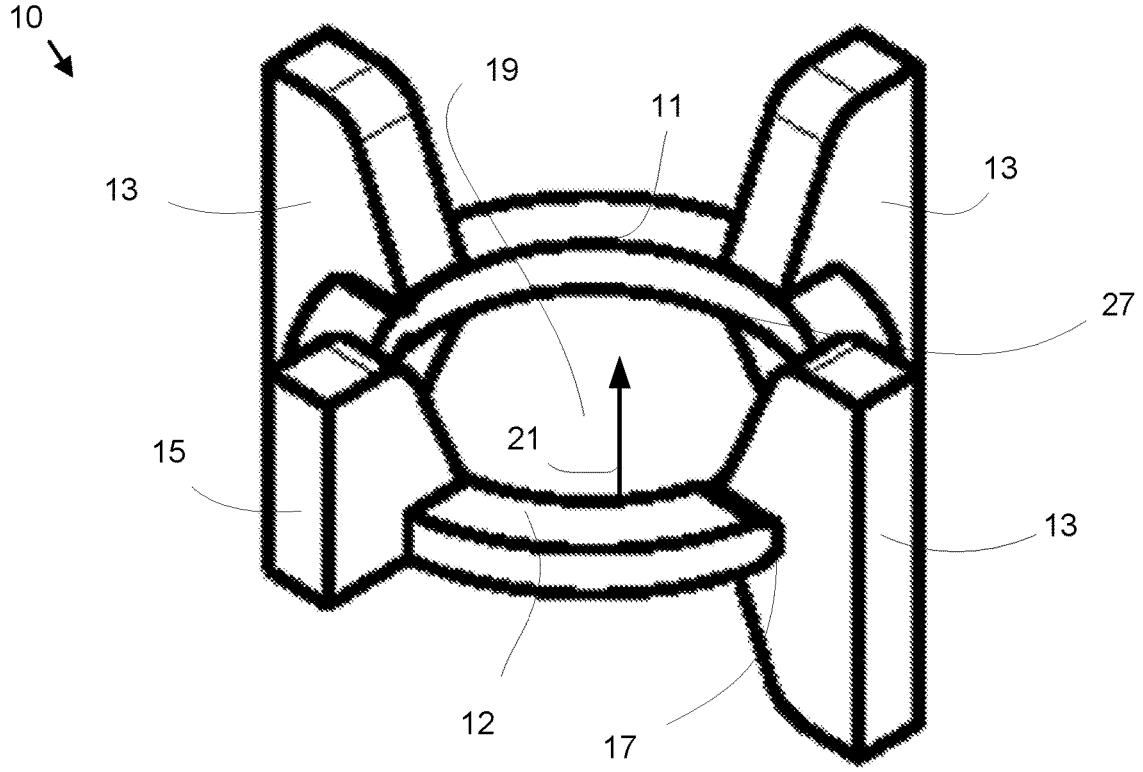
FIG. 1 is a perspective drawing illustrating one embodiment of a tile leveler.

FIG. 1 is a perspective drawing illustrating one embodiment of a tile leveler 10. The tile leveler 10 may be molded as a single piece. The tile leveler material may be selected from the group consisting of polyethylene and polypropylene. The tile leveler 10 includes a base 11. The base 11 comprises a base window 19. The base window 19 may be free of obstruction in a first axis 21. For example, a user looking along the first axis 21 through the base window 19 would have been unimpeded view of the intersection of one or more tile.

In the depicted embodiment, the base 11 is circular. The base window 19 may also be circular. In one embodiment, the base 11 forms a ring with the base window 19 in the center of the ring and a base inner edge 27 bounding the base window 19. The base 11 includes a base top 12.

The tile leveler 10 comprises one or more full joint spacers 13. In the depicted embodiment, the tile leveler 10 comprises three full joint spacers 13. Each full joint spacer 13 extends from the base 11 in a proximal direction relative to the first axis 21. In addition, each full joint spacer 13 extends from the base 11 in a distal direction relative to the first axis 21.

In one embodiment, the tile leveler 10 comprises a partial joint spacer 15 that extends from the base 11 in the proximal direction along the first axis 21. The partial joint spacer 15 does not extend from the base 11 in the distal direction along the first axis 21.

In one embodiment, the base 11 comprises one or more break lines 17. In a certain embodiment, each break line 17 is adjacent to a given full joint spacer 13 and/or the half joint spacer 15.

Figure 2:
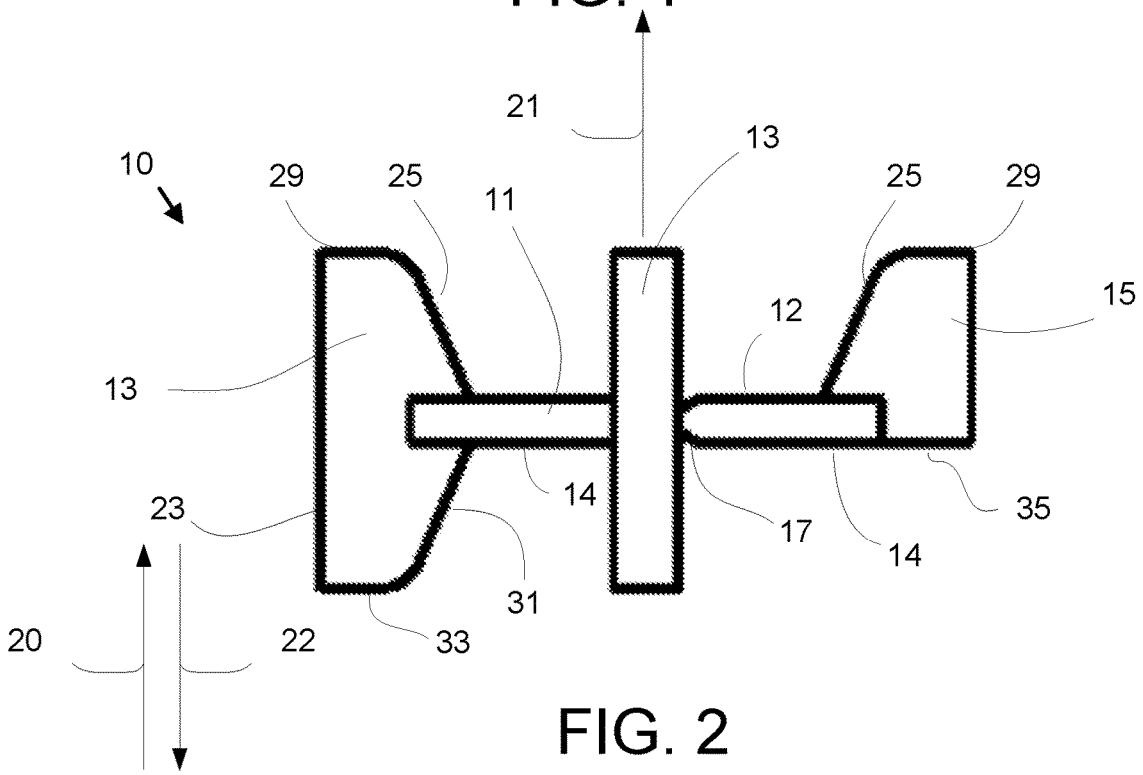
FIG. 2 is a side view drawing illustrating one embodiment of a tile leveler.

FIG. 2 is a side view drawing illustrating one embodiment of the tile leveler 10. In the depicted embodiment, the proximal direction 20 and the distal direction 22 are shown. Two full joint spacers 13 and a partial joint spacer 15 are shown disposed on the base 11. Each fall joint spacer 13 comprises an outer edge 23 that is parallel to the first axis 21. In addition, each full joint spacer 13 comprises a proximal inner edge 25. The proximal inner edge 25 does not extend beyond the base inner edge 27 into the base window 19.

Each full joint spacer 13 intersects the base top 12. In one embodiment, the proximal inner edge 25 of a full joint spacer 13 is flush with the base inner edge 27 as shown. Alternatively, the proximal inner edge 25 may intersect the base top 12 a specified inner edge distance from the base inner edge 27. The inner edge distance may be in the range of 1 to 5 mm as measured along an arc perpendicular to the first axis 21 from the center of the base window 19 to the proximal inner edge 25.

The proximal inner edge 25 may slope from the base top 12 and/or the first axis 21 to a proximal plane 29. In one embodiment, the proximal plane 29 is parallel to a base bottom 14.

Each full joint spacer 13 may further comprise a distal inner edge 31. The distal inner edge 31 does not extend beyond the base inner edge 27 into the base window 19. The distal inner edge 31 slopes outward from the first axis 21 and/or the base window 19 to a distal plane 33. In one embodiment, the distal inner edge 31 is flush with the base inner edge 27 is shown. Alternatively, the distal inner edge 31 may intersect the base bottom 14 a specified inner edge distance from the base inner edge 27. The inner edge distance may be in the range of 1 to 5 mm as measured along an arc perpendicular to the first axis 21 from the center of the base window 19 to the distal inner edge 31.

The partial joint spacer 15 comprises an outer edge 23 that is parallel to the first axis 21. In addition, the partial joint spacer 15 comprises a proximal inner edge 25. The proximal inner edge 25 does not extend beyond the base inner edge 27 into the base window 19.

The partial joint spacer 15 intersects the base top 12. In one embodiment, the proximal inner edge 25 of the partial joint spacer 15 is flush with the base inner edge 27. Alternatively, the proximal inner edge 25 may intersect the base top 12 a specified inner edge distance from the base inner edge 27. The inner edge distance may be in the range of 1 to 5 mm as measured along an arc perpendicular to the first axis 21 from the center of the base window 19 to the proximal inner edge 25.

In the depicted embodiment, the partial joint spacer 15 comprises a distal extension 35 that is flush with the base bottom 14. Alternatively, the distal extension 35 may extend in the distal direction 22 beyond the base bottom 14. In addition, the distal extension 35 may be recessed within the base bottom 14.

Figure 3:
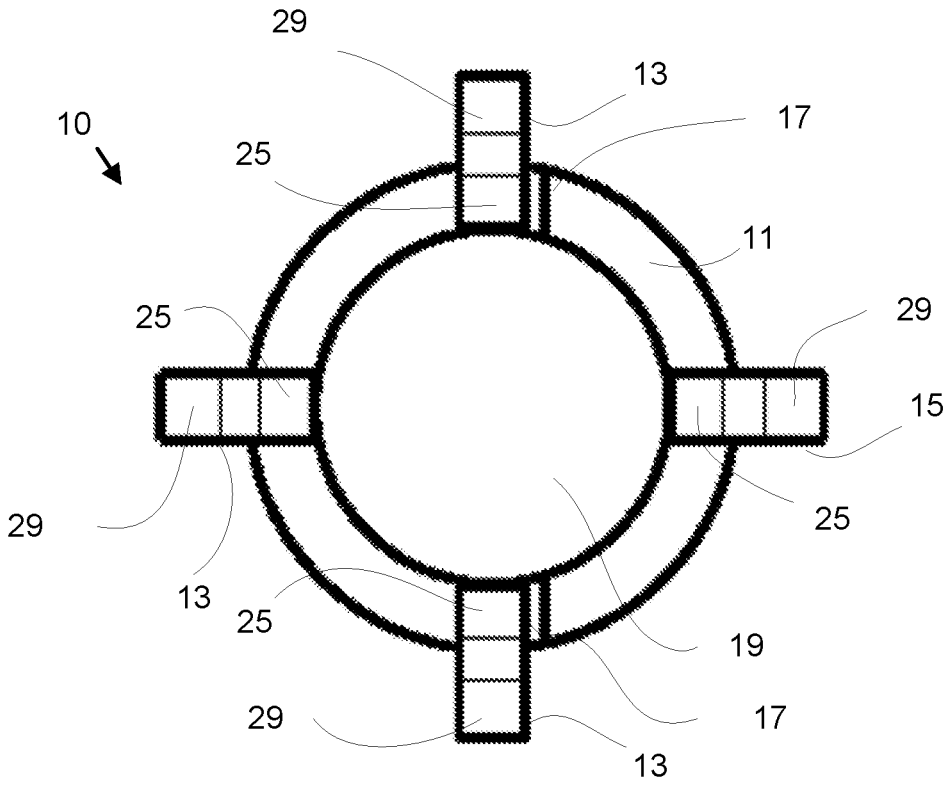
FIG. 3 is a top view drawing illustrating one embodiment of a tile leveler.

FIG. 3 is a top view drawing illustrating one embodiment of the tile leveler 10. Two break lines 17 are shown on the base 11. In addition, the proximal inner edges 25 and the proximal planes 29 are shown on the full joint spacers 13 and the partial joint spacer 15. The proximal inner edges 25 are shown flush with the base inner edge 27.

Figure 4:
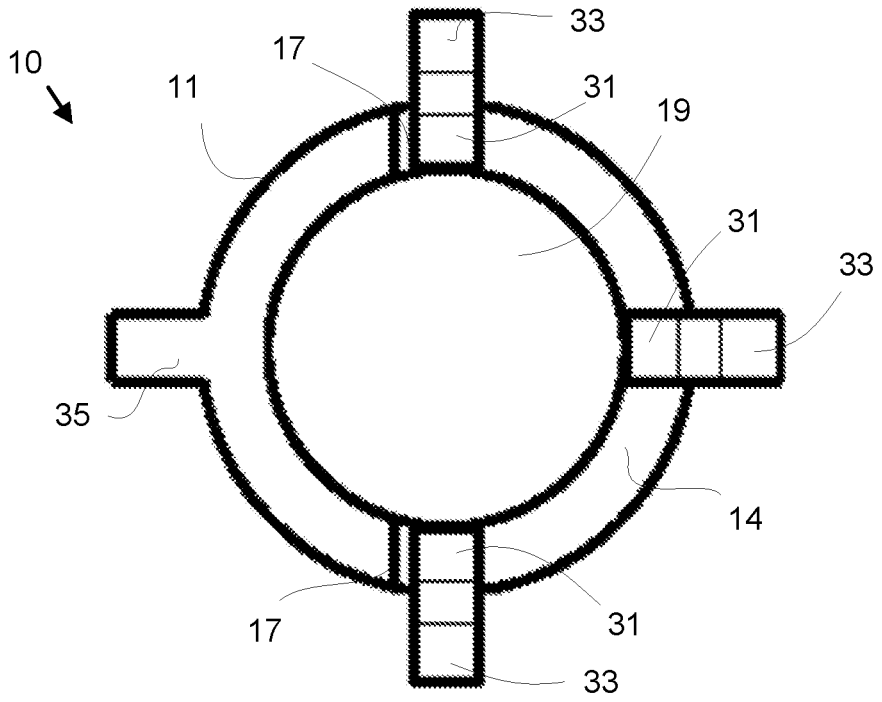
FIG. 4 is a bottom view drawing illustrating one embodiment of a tile leveler.

FIG. 4 is a bottom view drawing illustrating one embodiment of a tile leveler 10. In the depicted embodiment, to break line 17 are formed in the base 11. The distal inner edges 31 and the distal planes 33 of the full joint spacers 13 are shown. In addition, the distal extension 35 is shown is flush with the base bottom 14.

Figure 5:
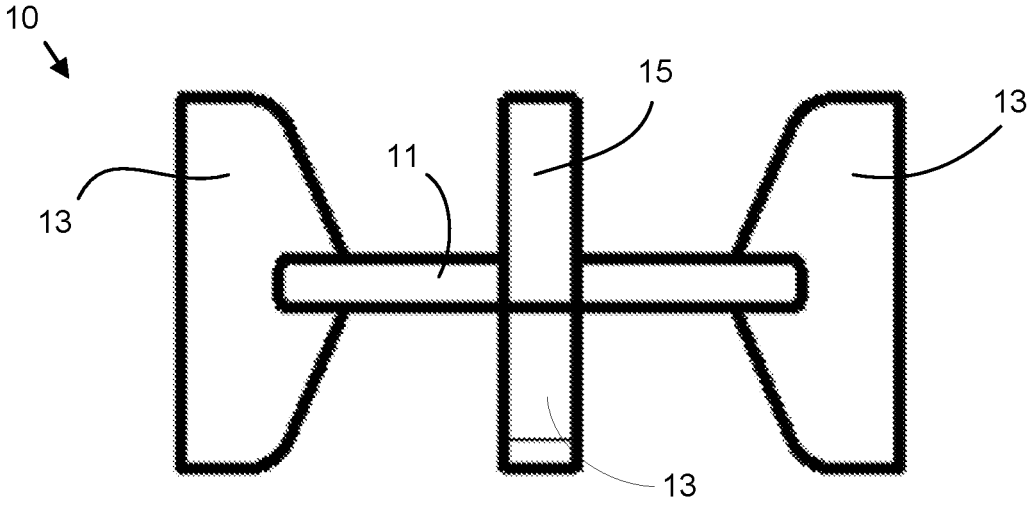
FIG. 5 is a back view drawing illustrating one embodiment of a tile leveler.

FIG. 5 is a back view drawing illustrating one embodiment of the tile leveler 10. The base 11 is shown with three full joint spacers 13 and the partial joint spacer 15 disposed on the base 11.

Figure 6:
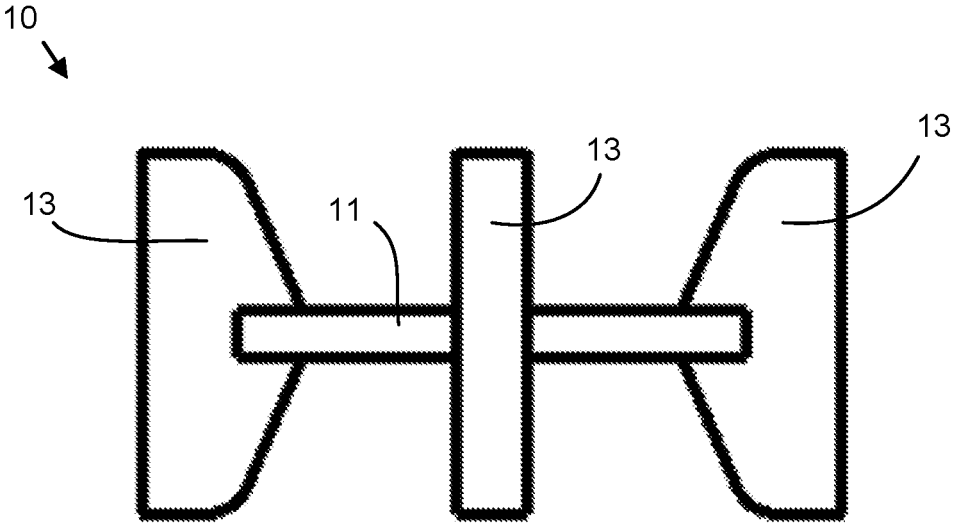
FIG. 6 is a front view drawing illustrating one embodiment of a tile leveler.

FIG. 6 is a front view drawing illustrating one embodiment of the tile leveler 10. In the depicted embodiment, the three full joint spacers 13 are disposed on the base 11.

Figure 7A:
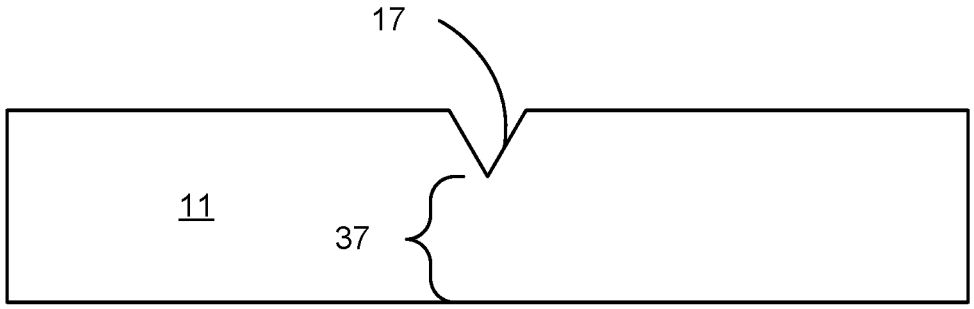
FIG. 7A is a side view drawing illustrating one embodiment of a break line.

FIG. 7A is a side view drawing illustrating one embodiment of a break line 17 in the base 11. In the depicted embodiment, the break line 17 is formed as an angled trench in the base 11. The angled trench may result in a segment of base material of the base 11 being thinned to a break thickness 37 in the range of 1.0 to 1.5 millimeters. In an alternative embodiment, the break line 17 may be formed as a rectangular trench in the base 11. The break line 17 may be formed on the top of the base 11 and/or on the bottom of the base 11.

Figure 7B:
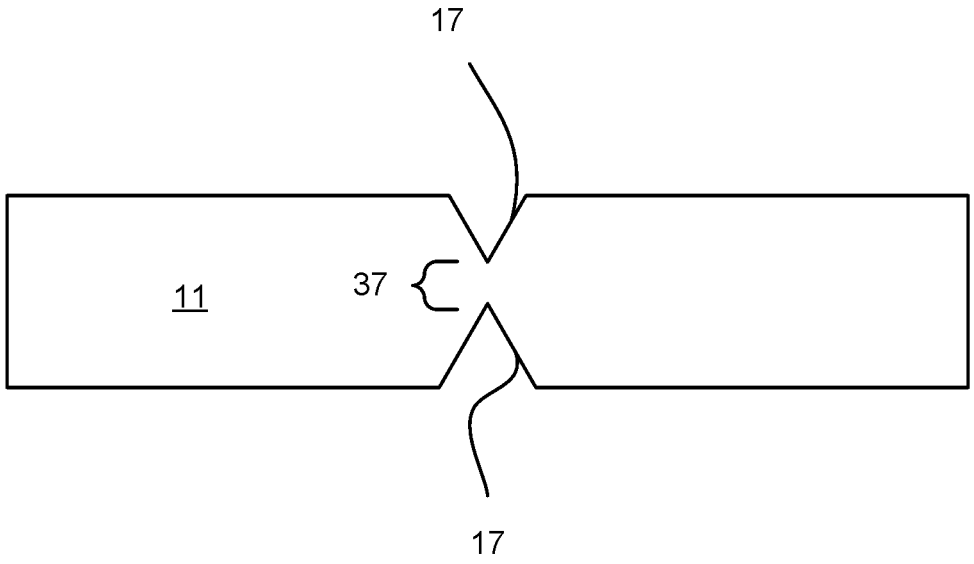
FIG. 7B is a side view drawing illustrating one alternate embodiment of a break line.

FIG. 7B is a side view drawing illustrating one alternate embodiment of a break line 15 in the base 11. In the depicted embodiment, two angled trenches are formed in the base 11. The angled trenches may thin the segment of base material to a break thickness 37 the range of 1.0 to 1.5 millimeters. The break thickness 29 may be selected so that bending a section of the base 11 back and forth along the break line 17 separates segments of the base 11 along the break line 17.

Figure 8:
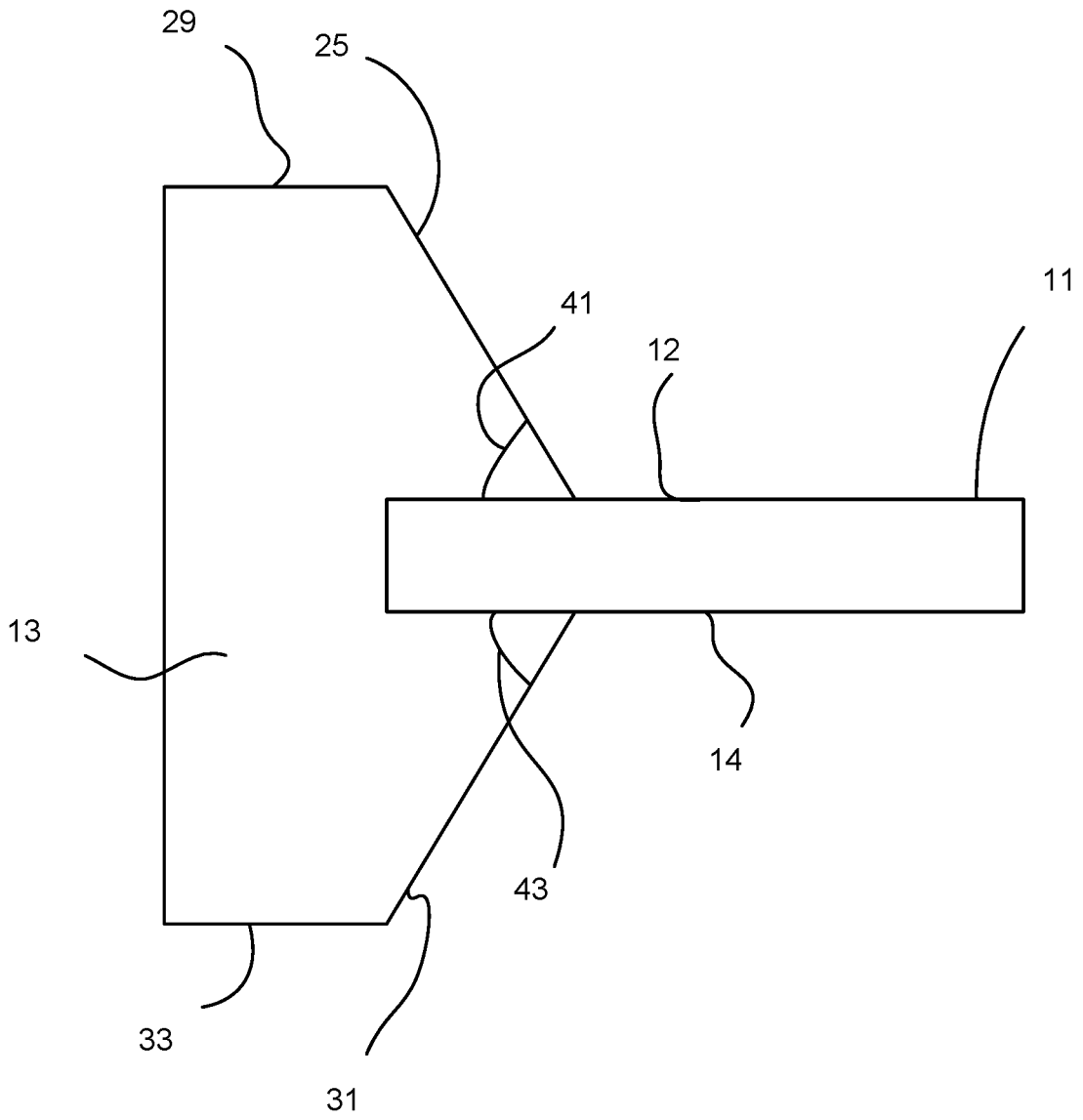
FIG. 8 is a side view drawing illustrating one embodiment of a full joint spacer.

FIG. 8 is a side view drawing illustrating one embodiment of a full joint spacer 15. The full joint spacer 15 is shown disposed on a portion of the base 11. A proximal slope 41 is shown relative to the base top 12. A distal slope 43 is shown relative to the base bottom 14. The proximal slope 41 and/or the distal slope 43 may be in the range of 45 to 80 degrees relative to the base 11.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tile leveler comprising:

a base comprising a base window that is free of obstruction in a first axis;

three full joint spacers, each having a midpoint, that extend from the base in a proximal direction relative to the first axis and extend from the base in a distal direction relative to the first axis;

a partial joint spacer that extends from the base in the proximal direction along the first axis and does not extend from the base in the distal direction along the first axis; and the base further centered substantially at the midpoint of the full joint spacers and comprising one or more break lines, wherein each break line is adjacent to a given full joint spacer and/or the partial joint spacer.

2. The tile leveler of claim 1, wherein each full joint spacer comprises an outer edge that is parallel to the first axis, a proximal inner edge that is flush with a base inner edge and slopes outward from the first axis to a proximal plane, and a distal inner edge that is flush with the base inner edge and slopes outward from the first axis to a distal plane.

3. The tile leveler of claim 2, wherein the proximal inner edge and/or distal inner edge has a slope in the range to 45 to 80 degrees to the base.

4. The tile leveler of claim 1, wherein the partial joint spacer comprises an outer edge that is parallel to the first axis, a proximal inner edge that is flush with a base inner edge and slopes outward from the first axis to a proximal plane, and a distal extension 35 that is flush with a base bottom.

5. The tile leveler of claim 1, where the break lines comprise a segment of base material thinned to a break thickness the range of 1.0 to 1.5 millimeters.

6. The tile leveler of claim 1, wherein the base is circular and the base window is circular.

* * * * *